US010324400B2

(12) United States Patent
Matsuura

(10) Patent No.: US 10,324,400 B2
(45) Date of Patent: Jun. 18, 2019

(54) IMAGE FORMING APPARATUS

(71) Applicant: CANON KABUSHIKI KAISHA, Tokyo (JP)

(72) Inventor: Taisuke Matsuura, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/891,817

(22) Filed: Feb. 8, 2018

(65) Prior Publication Data

US 2018/0231923 A1 Aug. 16, 2018

(30) Foreign Application Priority Data

Feb. 10, 2017 (JP) ..... 2017-022716

(51) Int. Cl.
*G03G 15/00* (2006.01)
*G03G 15/16* (2006.01)

(52) U.S. Cl.
CPC ..... *G03G 15/1675* (2013.01); *G03G 15/50* (2013.01); *G03G 15/5029* (2013.01); *G03G 15/5087* (2013.01); *G03G 2215/00063* (2013.01); *G03G 2215/00742* (2013.01)

(58) Field of Classification Search
CPC ..... G03G 15/1675; G03G 15/5029
See application file for complete search history.

(56) References Cited

U.S. PATENT DOCUMENTS 5,652,947 A 7/1997 Izumizaki
8,639,142 B2 * 1/2014 Aoki ..... G03G 15/161 399/101
9,383,691 B2 7/2016 Wada et al.
2010/0046969 A1 * 2/2010 Kim ..... G03G 15/1605 399/43
2011/0058831 A1 * 3/2011 Usami ..... G03G 15/1645 399/46
2011/0200348 A1 * 8/2011 Aoki ..... G03G 15/0131 399/66
2011/0255892 A1 * 10/2011 Aoki ..... G03G 15/1605 399/66

(Continued)

FOREIGN PATENT DOCUMENTS

JP 02-123385 A 5/1990
JP 05-181373 A 7/1993

(Continued)

*Primary Examiner* — Carla J Therrien
(74) *Attorney, Agent, or Firm* — Venable LLP

(57) ABSTRACT

An image forming apparatus includes a transfer member which transfers a toner image formed on an image bearing member to a transfer material; a transfer bias application unit which applies bias to the transfer member; a controller which executes a mode for making a first bias applied to a first predetermined area arranged at a leading edge of a transfer material with respect to a conveying direction of the transfer material to be less than a second bias applied to a second predetermined area arranged in a central area of the transfer material; and an obtaining portion which obtains image information of an image formed in each area obtained by dividing an area corresponding to the leading edge area into plural pieces in the width direction, wherein the controller controls the first bias based on image information obtained by the obtaining portion at the time of the mode.

8 Claims, 10 Drawing Sheets

(56) References Cited

U.S. PATENT DOCUMENTS

| | | | | |
|---|---|---|---|---|
| 2012/0045237 | A1* | 2/2012 | Aoki | G03G 15/1675 399/66 |
| 2015/0378284 | A1* | 12/2015 | Wada | G03G 15/1675 399/66 |
| 2017/0097593 | A1* | 4/2017 | Itagaki | G03G 15/1665 |
| 2017/0343944 | A1 | 11/2017 | Matsuura | |
| 2018/0259884 | A1* | 9/2018 | Watanabe | G03G 15/1675 |

FOREIGN PATENT DOCUMENTS

| | | | |
|---|---|---|---|
| JP | 05-323791 | A | 12/1993 |
| JP | 07-334018 | A | 12/1995 |
| JP | 2014-085553 | A | 5/2014 |
| JP | 2016-009116 | A | 1/2016 |

* cited by examiner

FIG. 7A

| LEADING EDGE | SECONDARY TRANSFER BIAS | | | | | | | | | |
|---|---|---|---|---|---|---|---|---|---|---|
| TONER-APPLIED AMOUNT | 2.0Kv | 2.5Kv | 3.0Kv | 3.5Kv | 4.0Kv | 4.5Kv | 5.0Kv | 5.5Kv | 6.0Kv | 6.5Kv |
| 120% | ○ | ○ | ○ | ○ | ○ | ○ | ○ | ○ | ○ | ○ |
| 110% | ○ | ○ | ○ | ○ | ○ | ○ | ○ | ○ | ○ | ○ |
| 100% | ○ | ○ | ○ | ○ | ○ | ○ | ○ | ○ | ○ | ○ |
| 90% | ○ | ○ | ○ | ○ | ○ | ○ | ○ | ○ | ○ | △ |
| 80% | ○ | ○ | ○ | ○ | ○ | ○ | ○ | △ | △ | × |
| 70% | ○ | ○ | ○ | ○ | ○ | ○ | △ | × | × | × |
| 60% | ○ | ○ | ○ | ○ | ○ | △ | △ | × | × | × |
| 50% | ○ | ○ | ○ | ○ | △ | △ | × | × | × | × |
| 40% | ○ | ○ | ○ | ○ | △ | × | × | × | × | × |
| 30% | ○ | ○ | ○ | ○ | △ | × | × | × | × | × |
| 20% | ○ | ○ | ○ | ○ | △ | × | × | × | × | × |
| 10% | ○ | ○ | ○ | ○ | △ | × | × | × | × | × |

Good : ○ Fair : △ Poor : ×

FIG. 7B

| TRAILING EDGE | SECONDARY TRANSFER BIAS | | | | | | | | | |
|---|---|---|---|---|---|---|---|---|---|---|
| TONER-APPLIED AMOUNT | 2.0Kv | 2.5Kv | 3.0Kv | 3.5Kv | 4.0Kv | 4.5Kv | 5.0Kv | 5.5Kv | 6.0Kv | 6.5Kv |
| 120% | ○ | ○ | ○ | ○ | ○ | ○ | ○ | ○ | ○ | ○ |
| 110% | ○ | ○ | ○ | ○ | ○ | ○ | ○ | ○ | ○ | ○ |
| 100% | ○ | ○ | ○ | ○ | ○ | ○ | ○ | ○ | ○ | ○ |
| 90% | ○ | ○ | ○ | ○ | ○ | ○ | ○ | ○ | ○ | △ |
| 80% | ○ | ○ | ○ | ○ | ○ | ○ | ○ | △ | △ | × |
| 70% | ○ | ○ | ○ | ○ | ○ | ○ | △ | × | × | × |
| 60% | ○ | ○ | ○ | ○ | ○ | ○ | △ | × | × | × |
| 50% | ○ | ○ | ○ | ○ | ○ | △ | × | × | × | × |
| 40% | ○ | ○ | ○ | ○ | ○ | △ | × | × | × | × |
| 30% | ○ | ○ | ○ | ○ | ○ | △ | × | × | × | × |
| 20% | ○ | ○ | ○ | ○ | ○ | △ | × | × | × | × |
| 10% | ○ | ○ | ○ | ○ | ○ | △ | × | × | × | × |

Good : ○ Fair : △ Poor : ×

*FIG. 8*

| | LEADING EDGE | TRAILING EDGE |
|---|---|---|
| TONER-APPLIED AMOUNT | SECONDARY TRANSFER BIAS UPPER LIMIT VALUE | |
| 120% | 6.5Kv | 6.5Kv |
| 110% | 6.5Kv | 6.5Kv |
| 100% | 6.5Kv | 6.5Kv |
| 90% | 6.0Kv | 6.0Kv |
| 80% | 5.0Kv | 5.0Kv |
| 70% | 4.5Kv | 4.5Kv |
| 60% | 4.0Kv | 4.5Kv |
| 50% | 3.5Kv | 4.5Kv |
| 40% | 3.5Kv | 4.0Kv |
| 30% | 3.5Kv | 4.0Kv |
| 20% | 3.5Kv | 4.0Kv |
| 10% | 3.5Kv | 4.0Kv |

IMAGE FORMING APPARATUS

BACKGROUND OF THE INVENTION

Field of the Invention

The present invention relates to an image forming apparatus for forming images by an electrophotographic system.

Description of the Related Art

Conventionally, for example, the image forming apparatus of a direct transfer method or an intermediate transfer method as described below is known as a color image forming apparatus capable of forming a full color image. In the direct transfer method, toner images formed on a plurality of photosensitive drums are transferred onto a transfer material carried on a belt member capable of circulating movement as a transfer material bearing member. In the intermediate transfer method, toner images formed on a plurality of photosensitive drums are temporarily transferred (primary transfer) onto a belt member (hereinafter, referred to as "intermediate transfer belt") capable of rotating as an intermediate transfer member. Thereafter, the toner image on the intermediate transfer belt is transferred (secondary transfer) onto a transfer material. In the intermediate transfer method, it is easy to form an image on various transfer materials, and the selectivity of the transfer material can be enhanced.

<About Transfer Bias Control Method>

In an apparatus that transfers a toner image to a transfer material by applying a constant voltage to a transfer member, it was carried out prior to image forming, and ATVC control method and PTVC control method are used as a method for setting the voltage condition to be used for image forming and are carried out before image forming. The ATVC control method and the PTVC control method will be described below.

[ATVC Control Method]

In the ATVC control (Active Transfer Voltage Control) method, a constant electric current corresponding to an electric current value necessary for transferring a toner image at the time of image formation is supplied (applied) to a transfer member through which a toner image has not been passed, and the output voltage value is measured. Then, based on the measurement result, a voltage value to be applied to the transfer member at the time of image formation is set (see Japanese Patent Laid-Open No. H2-123385).

[PTVC Control Method]

In the PTVC control (Programmable Transfer Voltage Control) method, constant voltages are applied in a plurality of stages to a transfer member through which a transfer material has not been passed, and the electric current value flowing to the transfer member at each stage is measured. An output voltage corresponding to an electric current value necessary for transferring a toner image at the time of image formation is interpolated from voltage-electric current data in a plurality of stages, and a voltage value to be used for image formation is set based on the calculation result. The electric current value necessary for transferring toner image as the target transfer electric current used at the time of image forming at this time is set according to a transfer electric current value table that is set according to the toner charging amount which varies depending on the temperature and humidity in the environment where the apparatus is placed (see Japanese Patent Laid-Open No. H5-181373).

<Leading and Trailing Edge Weak Bias>

Conventionally, countermeasures have been taken by the control method of the transfer bias called leading and trailing edge weak bias to cope with the following problem occurring when a toner image is transferred to a transfer material. This is a control method that limits the value of the transfer bias applied to a given region of the leading and trailing edges of the transfer material to less than or equal to a predetermined value. The leading and trailing edge weak bias will be described next.

FIGS. 3A and 3B are schematic diagrams enlarging the vicinity of a secondary transfer nip when the transfer material is conveyed to the secondary transfer nip. FIG. 3A is a schematic diagram of a state in which the transfer material is not in contact with the intermediate transfer belt within the discharge area of the secondary transfer bias. FIG. 3B is a schematic diagram of a state in which the transfer material is being conveyed in contact with the intermediate transfer belt within the discharge area of the secondary transfer bias.

As shown in FIG. 3A, when the transfer material P does not adhere to the intermediate transfer belt 7 in the discharge area at the upstream of the secondary transfer nip, a gap is made between the intermediate transfer belt 7 and the transfer material P, and a bias greater than or equal to a certain threshold value is applied to secondary transfer member 8. Then, abnormal discharge between the transfer material and the intermediate transfer belt reverses the charge polarity of the toner image on the intermediate transfer belt and this makes it impossible for the toner to move to the transfer material and remains on the intermediate transfer belt. This causes a problem in that a void image is generated.

Since the thick paper as the transfer material has a high basis weight, the stiffness of the paper is high, and the leading end of the transfer material P is hard to adhere to the intermediate transfer belt 7 when being conveyed to the secondary transfer nip, and as shown in FIG. 3A, a gap is likely to occur with the intermediate transfer belt 7, so the aforementioned void image tends to occur. After the tip of the transfer material P reaches the secondary transfer nip, the transfer material P comes into contact with the intermediate transfer belt 7 as shown in FIG. 3B, so the void image mentioned above is hard to occur.

As for the trailing edge of the transfer material, as with the leading edge portion, if the trailing edge of the transfer material passes through the pre-transfer guide member 13, the force with which the transfer material is pressed against the intermediate transfer belt weakens. For this reason, it becomes difficult to adhere to the intermediate transfer belt, and a gap is formed between the transfer material and the intermediate transfer belt, and the void image tends to occur.

In addition, since thin paper as transfer material has low basis weight, its stiffness is low but paper wrinkle is likely to occur, and therefore, in particular, the paper wrinkle portion of the paper leading and trailing edges are hard to adhere to the intermediate transfer belt. Likewise, there is a tendency for the above-mentioned void image to easily occur at the leading and trailing edge portions.

For the purpose of preventing such a void image, a configuration to prevent void image ("leading and trailing edge weak bias") has been proposed by applying a secondary transfer bias equal to or less than a predetermined value to the leading edge or trailing edge area of the transfer material when a sheet type such as thick paper or thin paper which is likely to cause void image is used (see Japanese Patent Laid-Open No. H7-334018).

<Video Count>

There is an apparatus that uses video count and uses the video count for toner supply control and the like (see Japanese Patent Laid-Open No. H5-323791). Multivalued video data at image processing, binary video data after intermediate tone processing, and the like are integrated for each pixel from the gradation value and the number of dots with the output level of the digital image signal for each pixel being the video count value, and obtains, from the video count value, the printing ratio of the output image in order to keep a constant toner density in the development device decreasing due to development. The toner amount consumed is calculated from the obtained printing ratio, and it is converted into the toner supply amount, and in order to supply the toner at the development time, the converted toner supply amount is sent to the CPU, and based on this toner supply amount, the toner supply signal is transmitted for a predetermined time. As a result, by driving the toner supply apparatus and supplying the necessary amount of toner amount in the developer container, the toner density in the developer container can be kept constant. In this way, control using video count is used.

However, in the control of leading and trailing edge weak bias shown in Patent Document 3, the transfer bias value decreases in a stepwise manner at the trailing edge of the transfer material, so the transfer efficiency differs between the intermediate area and the trailing edge area, and there is a problem that a density difference is generated depending on the image pattern. When image density is high, there is much toner-applied amount to be transferred, and much transfer electric current is required. Normally, the output value of transfer bias is set to the value that the transfer electric current flows with which toner equivalent for solid image can be transferred. When the output image is a halftone image, the toner-applied amount is small and the electric current required for transfer is also small, and therefore, even when the transfer bias value is lowered at the trailing edge portion of the transfer material by the weak bias control, the transfer can be performed sufficiently, and there will be no density difference at the intermediate area and trailing edge portion. However, when an output image such as a solid image has more toner-applied amount and more electric current is required for transfer, weak bias control causes the transfer electric current to run short, and the amount of toner that cannot be transferred increases, causing a problem of image density difference between the intermediate area and the trailing edge area.

The void image is conspicuous in the halftone image, and is characterized in that it is inconspicuous or it does not occur in solid image. This is because even if the abnormal discharge between the intermediate transfer belt and transfer material reverses the charged polarity of toner at one portion on the intermediate transfer belt and one portion of the toner remains on the intermediate transfer belt, there is much toner remaining in the periphery of the solid image, and therefore, it is possible to fill the portion made into a void image through the fixing process, and as a result it is difficult to make it appear as a void image.

However, in the transfer bias voltage control shown in Patent Document 1, the transfer bias in the trailing edge area is uniformly lowered, and therefore, even in an image that does not become a void image, setting the weak bias value lowers the transfer efficiency and may cause a density difference.

Therefore, in fact, in the case of a solid image, there is a characteristic that a void image is less likely to occur as compared with a halftone image. However, in the weak bias control, the control value is set so as not to cause void image in halftone image. Therefore, when outputting a solid image, the transfer efficiency decreased and density difference occurred.

SUMMARY OF THE INVENTION

It is desirable to provide an image forming apparatus which prevents void image at leading edge or trailing edge portion of a transfer material while preventing density difference.

In order to achieve the above, an image forming apparatus includes:

a transfer member which transfers a toner image formed on an image bearing member to a transfer material;

a transfer bias application unit which applies bias to the transfer member;

a controller which executes a mode for making a first bias applied to a first predetermined area arranged at a leading edge of a transfer material with respect to a conveying direction of the transfer material to be less than a second bias applied to a second predetermined area arranged in a central area of the transfer material; and an obtaining portion which obtains image information of an image formed in each area obtained by dividing an area corresponding to the leading edge area into plural pieces in the width direction, wherein the controller controls the first bias based on image information of the image formed in the each area obtained by the obtaining portion at the time of the mode.

According to the present invention, an image forming apparatus can be provided which prevents void image at leading edge or trailing edge portion of a transfer material while preventing density difference.

Further features of the present invention will become apparent from the following description of exemplary embodiments with reference to the attached drawings.

BRIEF DESCRIPTION OF THE DRAWINGS

FIGS. 7A and 7B are views showing the generation level of the void image of the transfer material leading and trailing edge portions.

FIG. 8 is a table for setting the upper limit value of the secondary transfer bias of the leading and trailing edge weak bias.

DESCRIPTION OF THE EMBODIMENTS

Preferred embodiments of the present invention will be exemplarily described in detail with reference to the drawings. However, the dimensions, materials, shapes, relative positions thereof, and the like of the constituent parts described in the following embodiments are to be appropriately changed according to the constitution and various conditions of the apparatus to which the present invention is applied. Therefore, unless otherwise specified, the scope of the present invention is not limited thereto.

Reference Example

Figure 2:
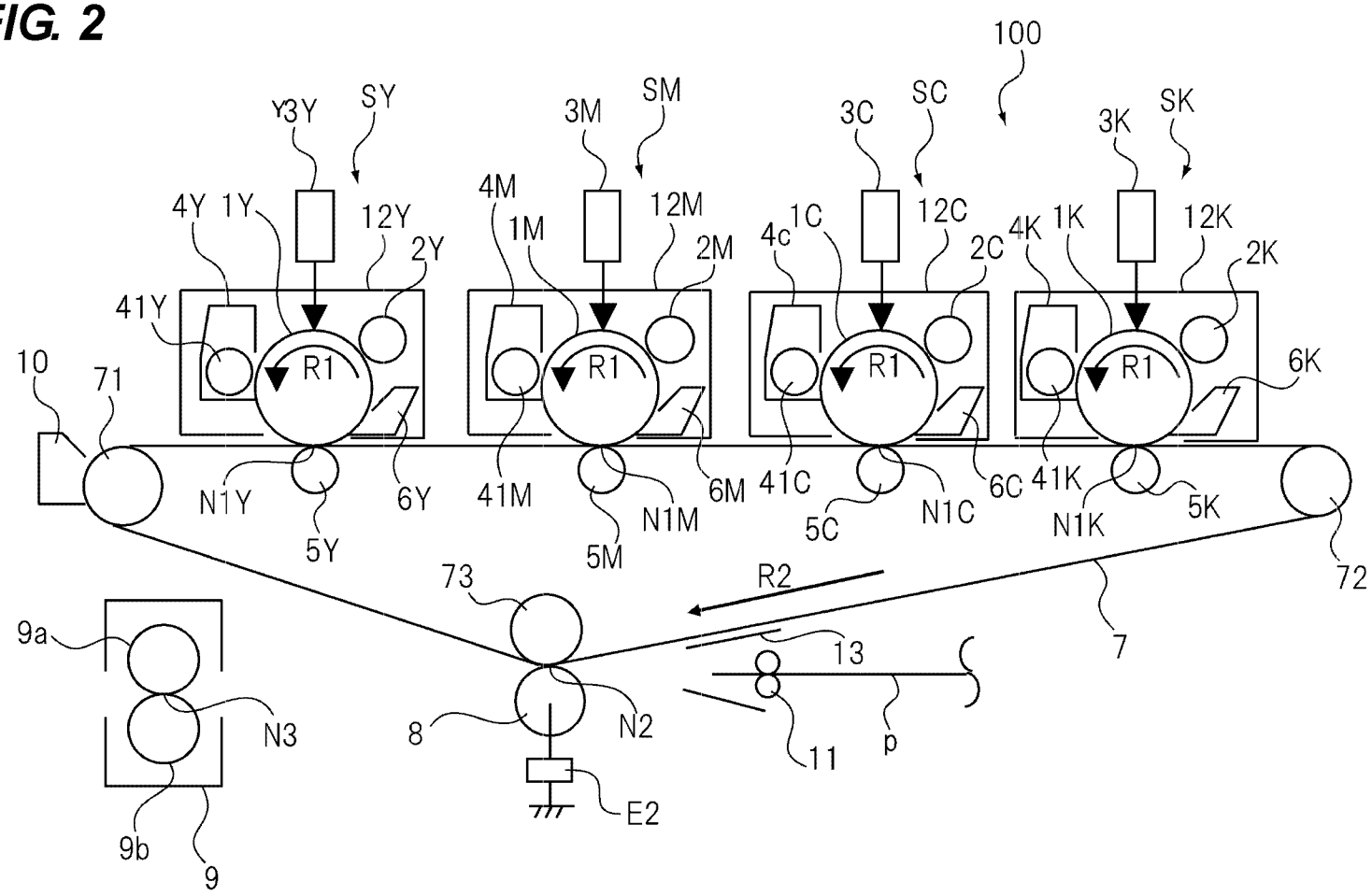
FIG. 2 shows an image forming apparatus.
Figure 3A:
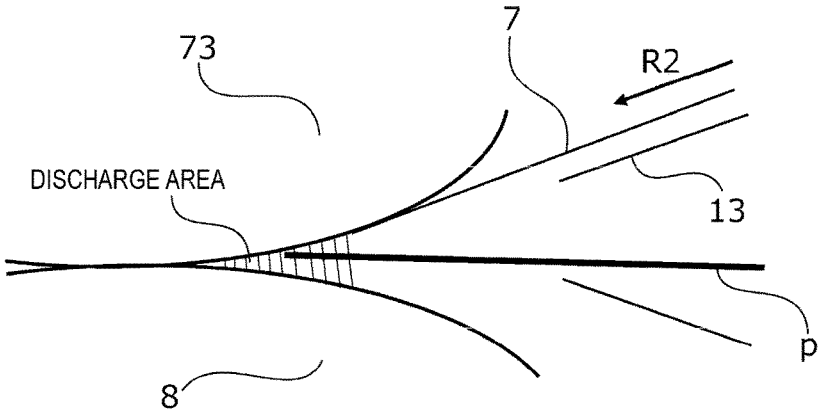
FIGS. 3A and 3B are views enlarging vicinity of a secondary transfer nip at the time of passing thick paper.
Figure 3B:
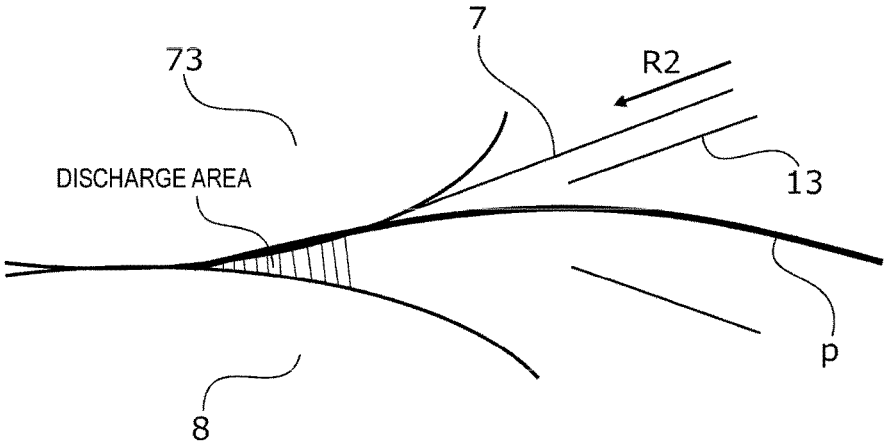

FIG. 2 is a schematic cross-sectional view showing a schematic configuration of an image forming apparatus 100. The image forming apparatus 100 is a tandem type printer employing an intermediate transfer method capable of forming a full color image by using an electrophotographic system.

The image forming apparatus 100 has four image forming portions (stations) SY, SM, SC, SK arranged in a row at regular intervals. Image forming portions SY, SM, SC, SK form images of yellow (Y) magenta (M), cyan (C), and black (K), respectively.

It should be noted that, in this case, the composition and operation of the image forming portions SY, SM, SC, SK are substantially the same except that the color of the toner used is different. Accordingly, hereinafter, in the case where distinction is not particularly required, the elements Y, M, C, K at the end of the code indicating that it is an element for any color are omitted, and the relevant elements will be described in a general manner.

The image forming portion S has a photosensitive drum 1 which is an electrophotographic photosensitive body (photosensitive body) of a drum-type (cylindrical) as a movable image bearing member. The photosensitive drum 1 is rotationally driven in the direction of arrow R1 in the figure. The following units are arranged around the photosensitive drum 1 in order along its rotation direction. First, a charging roller 2 which is a roller-shaped charging member as a charging portion is arranged. Next, an exposure apparatus 3 which is an exposure unit as an image forming unit is arranged. Next, the development apparatus 4 as a development unit is arranged. Next, a primary transfer roller 5, which is a roller-shaped primary transfer member, as a primary transfer portion for transferring the toner image from the image bearing member to the transferred body in the transfer portion, is arranged. Next, a drum cleaning apparatus 6 as an image bearing member cleaning unit is arranged.

An intermediate transfer belt 7 including an endless belt as an intermediate transfer member, which is an example of a transferred body, so as to face the photosensitive drums 1Y, 1M, 1C, 1K of the image forming portions SY, SM, SC, SK, is arranged. The intermediate transfer belt 7 is stretched with a predetermined tension around a driving roller 71, a tension roller 72 and a secondary transfer counter roller 73 as a plurality of stretching rollers (support rollers), and its inner surface is supported. As the driving roller 71 is driven to rotate, the intermediate transfer belt 7 is driven to rotate in the arrow R2 direction in the figure.

On the inner circumferential surface side of the intermediate transfer belt 7, the above-mentioned primary transfer roller 5 is disposed at a position facing the photosensitive drum 1. The primary transfer roller 5 is pressed against the photosensitive drum 1 via the intermediate transfer belt 7 and forms a primary transfer portion (primary transfer nip) N1 where the intermediate transfer belt 7 and the photosensitive drum 1 are in contact with each other.

On the outer peripheral surface side of the intermediate transfer belt 7, a secondary transfer roller 8 which is a roller-shaped secondary transfer member as a secondary transfer portion is disposed at a position facing the secondary transfer counter roller 73. The secondary transfer roller 8 is pressed against the secondary transfer counter roller 73 via the intermediate transfer belt 7 and forms a secondary transfer portion (secondary transfer nip) N2 where the intermediate transfer belt 7 and the secondary transfer roller 8 are in contact with each other. On the outer peripheral surface side of the intermediate transfer belt 7, a belt cleaning apparatus 10 as an intermediate transfer member cleaning unit is arranged at a position facing the driving roller 71.

In each image forming portion S, the photosensitive drum 1 and the charging roller 2, the development apparatus 4, and the drum cleaning apparatus 6 as process units acting thereon constitute a process cartridge 12 detachably attachable to the apparatus main body of the image forming apparatus 100.

When forming the image, the surface of the rotating photosensitive drum 1 to be rotated is charged substantially evenly by the charging roller 2. At this time, predetermined charging bias is applied to the charging roller 2 from the charging power supply as a charging bias application unit (not shown). Next, the surface of the charged photosensitive drum 1 is scanned and exposed by the exposure apparatus 3 according to image information corresponding to each image forming portion S, whereby an electrostatic image (electrostatic latent image) is formed on the surface of the photosensitive drum 1. Next, the electrostatic image formed on the photosensitive drum 1 is developed as a toner image by toner of a color corresponding to each image forming portion S by the development apparatus 4.

Next, the toner image formed on the photosensitive drum 1 is transferred (primary transfer) to the intermediate transfer belt 7 that is driven to rotate by the action of the primary transfer roller 5 in the primary transfer portion N1. At this time, from the primary transfer power supply as a primary transfer bias application unit (not shown), the primary transfer roller 5 is supplied with a primary transfer bias which is a DC voltage of a polarity opposite to the charging polarity of the toner at the time of development (positive polarity in this case). For example, when forming a full-color image, toner images of the colors formed on the photosensitive drums 1 of the image forming portions S are transferred so as to be sequentially superimposed on the intermediate transfer belt 7 at the primary transfer portions N1Y, N1M, N1C, N1K (primary transfer). The toner image transferred to the intermediate transfer belt 7 is transferred to the transfer material P such as recording paper by the action of the secondary transfer roller 8 in the secondary transfer portion N2 (secondary transfer). At this time, from the secondary transfer power supply E2 (FIG. 4) as the secondary transfer bias application unit, the secondary transfer roller 8 is supplied with a second transfer bias which is a DC voltage of a polarity opposite to the charging polarity of the toner at the time of development (positive polarity in this case). The transfer material P is fed by the transfer material supply roller 11 and conveyed to the secondary transfer nip by the pre-transfer guide member 13, and it is synchronized with the toner image on the intermediate transfer belt 7 and conveyed to the secondary transfer portion N2.

The transfer material P having the toner image transferred thereon and separated from the secondary transfer roller 8 is conveyed to a fixing apparatus 9 as a fixing unit. Then, the transfer material P is pressurized and heated by a fixing nip portion N3 between the fixing roller 9*a* and the pressure roller 9*b* of the fixing apparatus 9, and the toner image is fixed thereon. After the toner image is fixed, this transfer material P is discharged to the outside of the apparatus main body of the image forming apparatus 100.

At the primary transfer portion N1, the toner (primary transfer residual toner) remaining on the photosensitive drum 1 without being completely transferred to the intermediate transfer belt 7 is removed from the photosensitive drum 1 by the drum cleaning apparatus 6 and collected. At the secondary transfer portion N2, the toner (secondary transfer residual toner) remaining on the intermediate transfer belt 7 without being transferred to the transfer material P is removed from the intermediate transfer belt 7 by the belt cleaning apparatus 10 and collected.

A laser scanner apparatus that scans a laser beam modulated according to image information along the longitudinal direction (rotation axis direction) of the photosensitive drum 1 is used as the exposure apparatus 3.

A two component development apparatus that adopts a two component development method mainly using two component developers including non-magnetic toner particles (toner) and magnetic carrier particles (carrier) as a developer is used as the development apparatus 4. The development apparatus 4 conveys the developer to the facing portion (development portion) with the photosensitive drum 1 by a development sleeve 41 as a rotatable developer bearing member. By applying development bias to development sleeve 41, the toner from the developer on the development sleeve 41 is transferred to the photosensitive drum 1 according to electrostatic image. A development bias in which an AC voltage component is superimposed on a negative DC voltage component Vdc is applied to the development sleeve 41 from the development power supply as a development bias application unit (not shown). The development polarity (normal charging polarity) of toner at development is negative. The development apparatus 4 forms a toner image by a reversal development method. The reversal development method is a development method in which the toner charged to the same polarity as the charging polarity of the sensitive body is applied to the exposed portion of the surface of the photosensitive body whose absolute value of the potential has decreased after being uniformly charged and exposed according to the image information, so that the toner image is formed. The developing apparatuses 4Y, 4M, 4C, 4K accommodate toners of yellow, magenta, cyan and black as toners.

The length of the secondary transfer roller 8 in the longitudinal direction (rotation axis direction) is 320 mm. In this secondary transfer roller 8, a foamed sponge as an elastic layer is provided around a stainless steel core metal having a diameter of 12 mm. For example, the secondary transfer roller 8 is configured as a roller having a volume resistance value of $5\times10^{7}$ to $1\times10^{8}\Omega$ and a diameter of 24 mm. This secondary transfer roller 8 is constructed using an ion conductive foamed sponge. Nitrile butadiene rubber (NBR) containing an ionic substance was used as a material of foam sponge (foam roller). Since this secondary transfer roller 8 is a roller using anion conductive material, the electrical resistance value tends to change greatly due to the influence of environmental factors such as temperature and humidity on conductivity.

A roller using an ion conductive material has better dispersibility of a conductive material than a roller using a carbon conductive material, and is characterized by a relatively small circumference unevenness of electrical resistance value and lot variation. On the other hand, it is hygroscopic, and conductivity is affected by environmental factors such as temperature and humidity, and electric resistance value may change greatly. In addition, by continuing energization, bias of the ion conductive material occurs, and its electric resistance value may increase.

Figure 4:
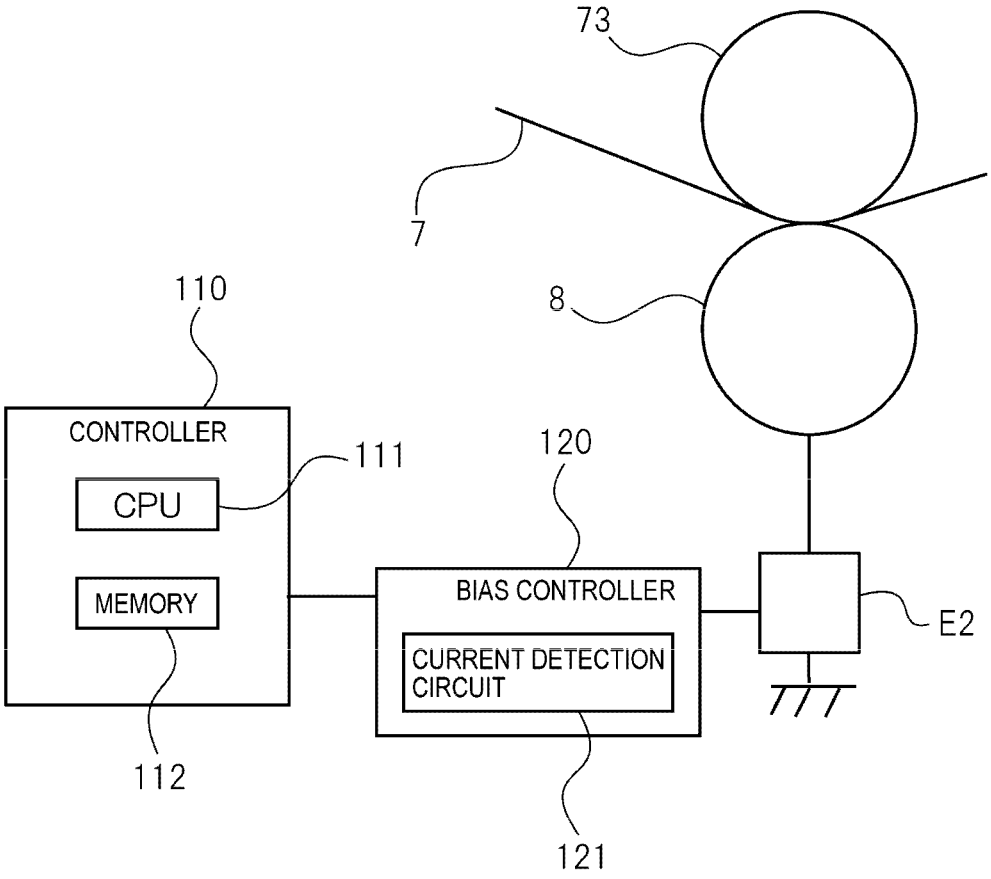
FIG. 4 is a figure illustrating the secondary transfer power supply high voltage portion.

FIG. 4 shows an overview control aspect of a main portion of the image forming apparatus 100. The controller 110 has a CPU 111 as a control element as a central element for performing calculation processing, a memory (storage medium body) 112 such as ROM and RAM as a storage unit, and the like as a storage unit. The RAM which is a rewritable memory stores information input to the controller 110, detected information, calculation result and the like, and the ROM stores a control program, a data table obtained in advance, and the like. The CPU 111 and the memory 112 such as the ROM and the RAM can transfer and read data mutually.

A secondary transfer power supply (high voltage circuit) E2 is connected to the secondary transfer roller 8. A bias controller 120, which controls the bias that the secondary transfer power supply E2 applies to the secondary transfer roller 8 under the control of the controller 110, is connected to the secondary transfer power supply E2. The bias controller 120 is provided with an electric current detection circuit 121 as a detection unit for detecting an electric current value flowing when a predetermined voltage value bias is applied to the secondary transfer roller 8 by the secondary transfer power supply E2.

The secondary transfer power supply E2 has only a constant voltage circuit and uses PTVC control as a control to determine the bias condition applied to secondary transfer roller 8 by secondary transfer power supply E2 for secondary transfer. The range of the output value of the secondary transfer power supply E2 is 0 to 6.5 kV.

The controller 110 comprehensively controls each portion of the image forming apparatus 100 to perform sequence operation. The controller 110 receives an image forming signal (image data, control command) and the like from an outside host apparatus (not shown) such as an image reading apparatus or a personal computer, and controls each portion of the image forming apparatus 100, and accordingly, an image forming operation is executed.

<Transfer Bias Control>

The determination of the secondary transfer voltage value by the PTVC control is performed at the timing of the pre-rotation of each image formation. The secondary transfer roller 8 uses an ion conductive material, and the electric resistance value tends to change greatly depending on environmental factors such as temperature and humidity and the current application time. The PTVC control makes it possible to apply the optimal transfer bias even when there is a change in the resistance value of the secondary transfer roller 8.

Figure 5:
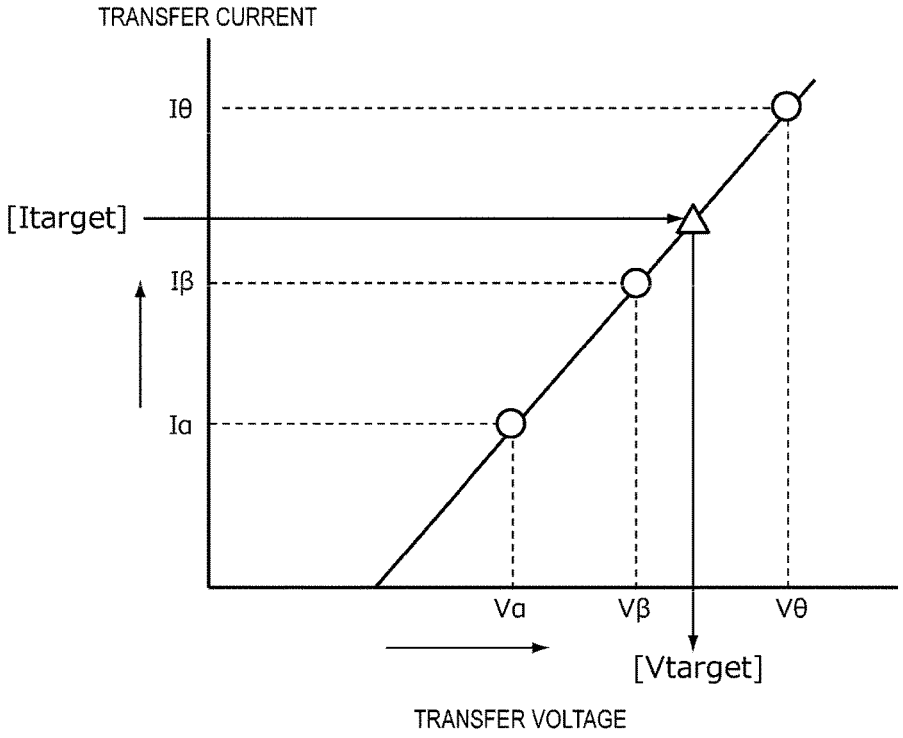
FIG. 5 is a figure for describing PTVC control of transfer bias control.

The PTVC control in the present reference example will be described in more detail. FIG. 5 is a schematic diagram showing the relationship (voltage-electric current characteristic) between application voltage value and detected electric current value measured in PTVC control.

The flow for calculating secondary transfer bias value (Vout) at the time of formation of image (at image forming time) by PTVC control is as follows. Multiple levels of voltage values $V\alpha$, $V\beta$, $V\theta$ with different potentials are applied to the secondary transfer roller 8 during the pre-rotation period in which the toner image does not pass through the secondary transfer portion, and the electric current values $I\alpha$, $I\beta$, $I\theta$ flowing at that time are detected by electric current detection circuit 121. Then, from the voltage-electric current characteristic, the voltage value corresponding to the target electric current (Itarget) required for the secondary transfer is interpolated and calculated, and the transfer voltage (Vtarget) corresponding to the target electric current (Itarget) is obtained. Further, the divided voltage value corresponding to the resistance value of the transfer material set in advance according to the type of transfer material is added to the transfer voltage (Vtarget) obtained above to obtain the secondary transfer setting voltage (Vout). When the value of the secondary transfer bias value (Vout) at formation of image obtained by PTVC control exceeds 6.5 kV which is upper limit value of output of secondary transfer power supply E2, the upper limit value thereof, i.e., 6.5 kV, is applied as the transfer voltage value.

In the present reference example, the CPU 111 of the controller 110 as the determination unit executes control of acquisition operation of voltage and electric current characteristics in the PTVC control as described above, calculation and determination of secondary transfer bias value at formation of image by PTVC control.

<Division Video Count>

The video count of the apparatus in the present reference example is to divide the image area (image data) in the transfer direction of the transfer material (sub-scanning direction) to acquire the accumulated value of video count for each area divided into plural pieces. The output level is accumulated for each pixel by video count and it is used to calculate the applied amount of toner for each area divided in the sub-scanning direction.

Figure 6:
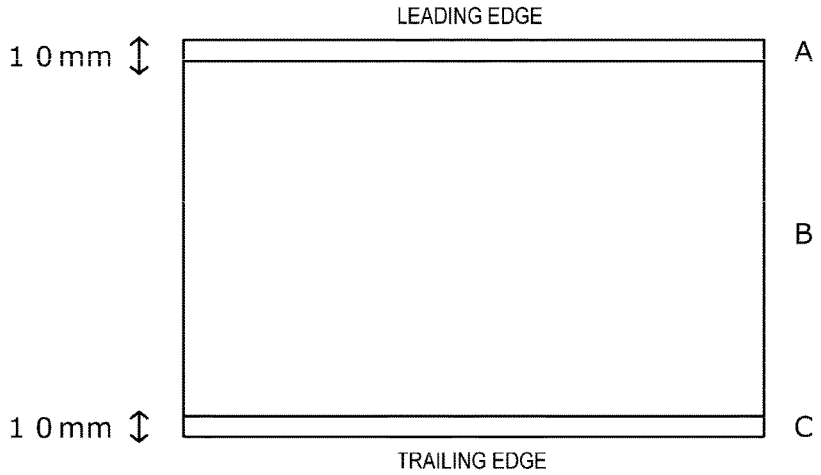
FIG. 6 is a figure showing division classification of image data by division video count according to a reference example.

In the apparatus of the present reference example, image data is stored for each area unit divided in the sub-scanning direction, and as shown using the image data of A4 size of FIG. 6, the image data is divided in the sub-scanning direction into three classifications, i.e., A: image leading edge in a specified (here 10 mm) range from the leading edge area, B: central area in the range from an image leading edge 10 mm to an image trailing edge 10 mm, and C: trailing edge area in a predetermined (here 10 mm) range from the image trailing edge.

The processing flow of the input image data will be described. The input image data is converted from a luminance value (here RGB) to a density value (here CMYK) by the CPU 111. For the image data converted into CMYK data which is a density value, multivalued data for each color component of each pixel is accumulated. The CPU 111 integrates multivalued data in which each color component data per pixel of image data is represented by a plurality of bits in a unit of precision for each color component of each pixel.

In each color component having a gradation of 8 bits (0 to 255), when the Y data of the first pixel is a value of "100" and the Y data of the second pixel is a value of "50", the accumulated value of the first pixel and the second pixel is "150".

In the case of A4 size: 600 dpi image data, color components for a total of 34808430 pixels in main scanning direction: 7015 pixels×sub-scanning direction: 4962 pixels are integrated per page. Here, the main scanning direction is a direction in which light corresponding to image information is scanned on the surface of a photosensitive drum, and is a width direction orthogonal to the transfer direction of the transfer material. The sub-scanning direction is a direction orthogonal to the main scanning direction and is the transfer direction of the transfer material.

In the main apparatus, each color component data of all pixels of the above three classifications is counted by division video count and the toner-applied amount of each classification is calculated using the integrated value. In addition, the input image data is counted by the CPU (control unit) of the controller 110 shown in FIG. 4, and the toner-applied amount is calculated from the counted video count value. More specifically, the CPU 111 of the controller 110 serves not only as a video count unit counting image data for each area divided into multiple pieces in the conveying direction of the transfer material but also as an applied amount calculation unit which calculates the toner-applied amount for each of the divided areas from the count value calculated by the video count unit.

<Leading and Trailing Edge Weak Bias of Present Reference Example>

For the leading and trailing edge weak bias of the present reference example, a determination is made as to whether to apply the leading edge and trailing edge weak bias by determining whether the applied-amount of toner equal to or more than a threshold value is placed in the entire area of each of the leading edge portion and the trailing edge portion in the area divided into three described above in order to prevent void image and prevent density difference.

The toner-applied amount will be described. The image data input to the image forming portion is data of 0 to 255 of 600 dpi. This data per pixel is called image data amount, and the maximum image data amount of each color is expressed as 100%. According to this 0 to 100% image data amount, the toner amount to form an image is calculated, and the toner-applied amount is expressed as 0 to 100% like the image data amount.

The applied-amount of solid color solid image is 100%, and in the case of images with multiple colors overlapping, it is controlled not to exceed the maximum toner-applied amount of the apparatus. The maximum toner-applied amount during image forming of the main apparatus is set to 200%. In the case where it is 100% which is the applied amount of a solid color solid image, the toner-applied amount is 0.5 mg/cm$^2$. In the case where it is 200% which is the maximum toner-applied amount when multiple colors are superimposed, the toner-applied amount is 1.0 mg/cm$^2$. The maximum toner-applied amount is set to a value with which the toner transferred to the transfer material does not cause fixing failure.

The threshold value of toner-applied amount to which the leading and trailing edge weak bias is applied will be described. FIGS. 7A and 7B illustrate an experiment in which an image of a uniform predetermined toner-applied amount was transferred to the leading edge area A and the trailing edge area C of the transfer material in FIG. 6, using A4-sized thick paper with a basis weight of 209 g/m$^2$, and the occurrence situation of void image was summarized by giving the toner-applied amount and the secondary transfer bias (to 6.5 kv), respectively. The occurrence degree of void image was evaluated by visual observation. A case where void image did not occur is indicated by "Good". A sample in which a slight void image was generated was represented by "Fair". A void image occurred in a wide range was represented by "Poor".

In the case where a solid image of toner-applied amount of 100% or more was placed on the leading edge portion thus divided, void image was not generated and the result was "Good" even when the secondary transfer bias 6.5 Kv which is the maximum output was applied. In the case where an image with toner-applied amount of 80% was placed, slight void image was generated and the result was "Fair" when the secondary transfer bias 5.5 Kv was applied, and void image did not occur and the result was "Good" when the secondary transfer bias was reduced to 5.0 Kv. In the case where an image with toner-applied amount of 70% was placed, void image occurred in a large area and the result was "Poor" when the secondary transfer bias 5.5 Kv was applied, and void image did not occur and the result was "Good" when the secondary transfer bias was reduced to 4.5 Kv. When the secondary transfer bias was reduced to 3.5 Kv, void image no longer occurred regardless of toner-applied amount.

As for the void image of the trailing edge portion, the evaluation results are summarized in FIG. 7B as well as the leading edge portion shown in FIG. 7A. According to the experimental result at the trailing edge portion in FIG. 7B, in the main apparatus, the value of the secondary transfer bias is slightly different at the trailing edge portion from the leading edge portion until the void image occurs, but this does not mean that it is different depending on the construction of the apparatus, and the trailing edge portion is advantageous compared to the leading edge portion.

From the result of FIGS. 7A and 7B, a weak bias table in which the toner-applied amount and the upper limit value of the secondary transfer bias according to its toner-applied amount in the leading and trailing edge areas of the transfer material is shown in FIG. 8. In the table of FIG. 8, the toner-applied amount is 10% increments, but for the toner-applied amount during that time, the secondary transfer bias value is obtained by linear interpolation.

Figure 1:
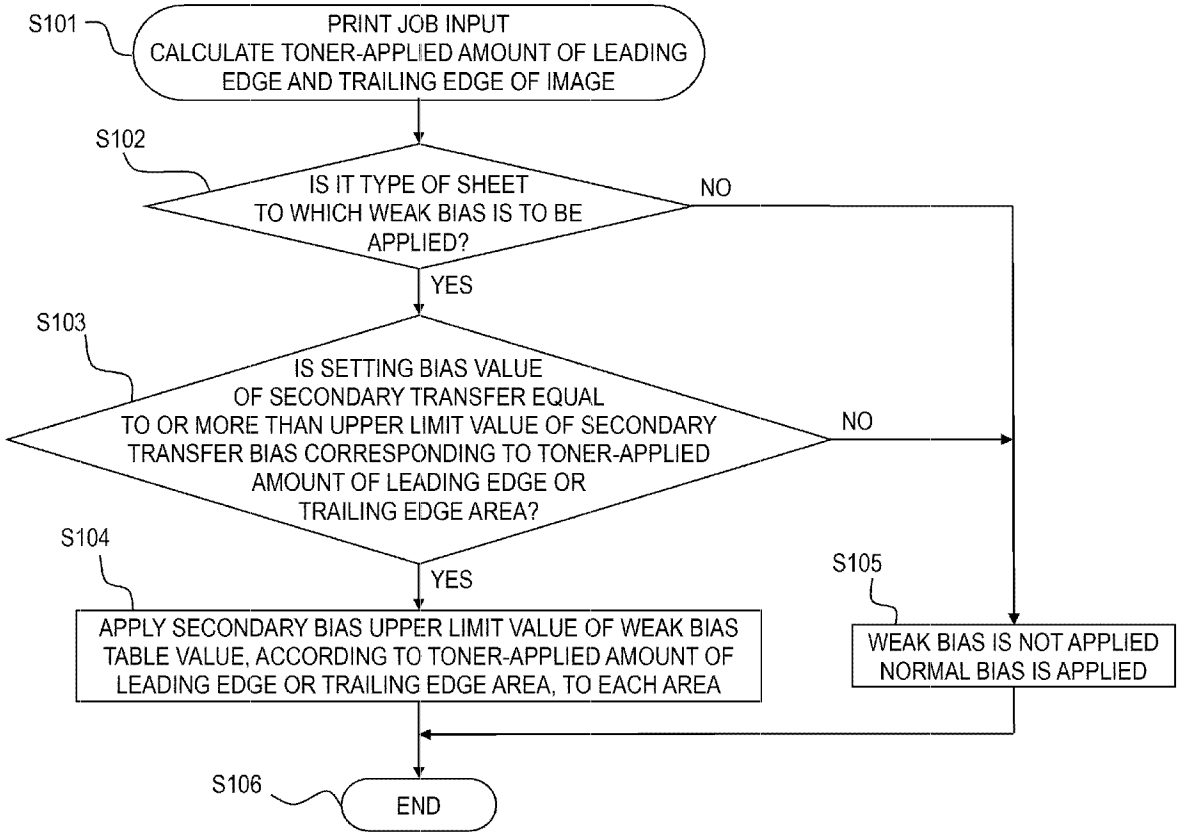
FIG. 1 shows a control flow diagram of leading and trailing edge weak bias according to a reference example.

The control flow of the leading and trailing edge weak bias will be described with reference to FIG. 1. In the control of the present reference example, the CPU 111 of the controller 110 sets the upper limit value of the secondary transfer bias to be applied for each area according to the toner-applied amount for each divided area (here, the leading edge area and trailing edge area), and controls the leading and trailing edge weak bias.

In this case, explanation will be made by showing an example in which A4-sized thick paper with a basis weight of 209 g/m$^2$ is used as a transfer material, and an image is printed in which there is a solid image with a toner-applied amount of 100% in the area of the leading edge 10 mm divided in the sub-scanning direction, and a halftone image in which the toner-applied amount is 40% in the area of the trailing edge 10 mm.

First, a print JOB is input, and the type of the selected transfer material and the image data are sent to the CPU 111 of the controller 110, and the toner-applied amount is calculated for the toner image of the leading edge area and the trailing edge area of the image data, out of the 3 division areas (S101). Next, it is determined whether the sheet type (transfer material type) set for printing is the sheet type to which weak bias control is applied (S102). In the main control, the basis weight is exemplified as the type of transfer material, and weak bias is applied in the transfer material whose basis weight is equal to or larger than the predetermined value. In this case, weak bias is applied to the transfer material with basis weight of 200 g/m$^2$ or more. As mentioned above, the type of transfer material selected is the basis weight of 209 g/m$^2$, which is the sheet type to which weak bias is applied, and therefore, the following comparison is made. More specifically, by referring to the secondary transfer bias value set by the PTVC control executed at the pre-rotation operation and the weak bias table of FIG. 8 stored in the memory 112, the upper limit value of each secondary transfer bias set by the toner-applied amount of the leading edge area and the trailing edge area are compared (S103). When the secondary transfer bias value set by the PTVC control is equal to or larger than the upper limit value according to the toner-applied amount, the upper limit value of the weak bias table corresponding to the toner-applied amount in FIG. 8 is applied to the leading edge area and trailing edge area. It should be noted that, in the divided area, the secondary transfer bias set by the PTVC control is applied to the area of the central portion other than the above area (the central area B in FIG. 6) (S104).

Here, the secondary transfer bias value set by the PTVC control was 4.5 Kv. The toner-applied amount of the leading edge area is 100% solid image, and from the weak bias table of FIG. 8, the upper limit value of the secondary transfer bias of the leading edge area is 6.5 Kv of the high voltage maximum value. Therefore, the upper limit value corresponding to the toner-applied amount is larger than the secondary transfer bias value set by the PTVC control. Therefore, 4.5 Kv of the setting value is applied to the leading edge area (area within 10 mm from the leading edge). The setting value of 4.5 Kv is applied to the area of the central portion. The toner-applied amount in the trailing edge area is a 40% half-tone image and the upper limit value of the secondary transfer bias in the trailing edge area is 4.0 Kv. More specifically, the secondary transfer bias value set by the PTVC control is smaller than the upper limit value corresponding to the toner-applied amount. Therefore, the weak bias control is applied, 4.0 kv of the upper limit value is applied to the trailing edge area (area within 10 mm from the trailing edge), and the formation of image operation of the input image data is ended (S106).

In the case where the sheet type set for printing is not the sheet type to which the weak bias control is applied (S102), the secondary transfer bias value by the PTVC control is applied without applying the weak bias (S105). When the secondary transfer bias value set by the PTVC control is less than the upper limit value of each secondary transfer bias set by the toner-applied amounts of the leading edge area and the trailing edge area of the weak bias table (S103), the secondary transfer bias value by PTVC control is applied without applying the weak bias (S105).

As described above, the weak bias control is performed according to the toner-applied amount of the leading edge area and the trailing edge area divided in the sub-scanning direction, so that void image is unlikely to occur. Furthermore, if there is a solid image that requires a lot of transfer electric current, it is possible to apply a higher secondary transfer bias value than a halftone image portion, and it is possible to prevent the void image in the halftone image portion without causing a density difference due to the difference in transfer efficiency from other areas.

In the present reference example, the weak bias control is performed in the leading and trailing edges area 10 mm because the void image occurs in the leading and trailing edges area 10 mm in the main apparatus. The occurrence area of the void image varies depending on the position and configuration of the pre-transfer guide member of the apparatus and the transfer speed of the transfer material, and therefore, the area where the leading and trailing edge weak bias is applied is not limited to 10 mm, but is preferably set according to the apparatus to be implemented.

First Embodiment

Since the image forming apparatus of the first embodiment is similar to the image forming apparatus of the reference example, the reference example is referred to as to its specific description.

The weak bias is set by dividing image data into three in the sub-scanning direction of the reference example apparatus, but in the apparatus of the first embodiment, the area of the leading and trailing edges obtained by dividing the image data in the sub-scanning direction is further divided in the main scanning direction, and, for each area, the toner-applied amount is calculated from the video count value of image data.

Figure 9:
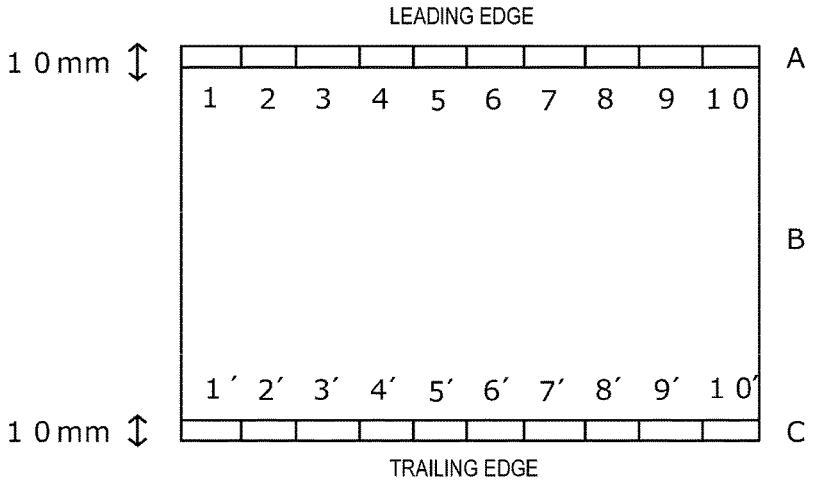
FIG. 9 is a figure showing division classification of image data by division video count according to a first embodiment.

FIG. 9 shows a diagram obtained by dividing A4 size image data. In the present embodiment, the image data is divided in the sub-scanning direction into three classifications, i.e., A: a range within 10 mm from the image leading edge, B: a range between 10 mm from the image leading edge and 10 mm from the image trailing edge, and C: a range within 10 mm from the image trailing edge, and is further divided into 10 in the main scanning direction, so that the leading edge area is 1 to 10. The trailing edge area is 1 'to 10'.

<Leading and Trailing Edge Weak Bias of the Present Embodiment>

For the leading and trailing edge weak bias of the present embodiment, a determination is made as to whether to apply the leading edge and trailing edge weak bias upon calculating the toner-applied amount in the area of each of the leading and trailing edges divided into multiple pieces in the main scanning direction and the sub-scanning direction and determining whether toner equal to or more than a threshold value is placed in each area or not. In the weak bias table, FIGS. 7A and 7B are used like the reference example.

Figure 10:
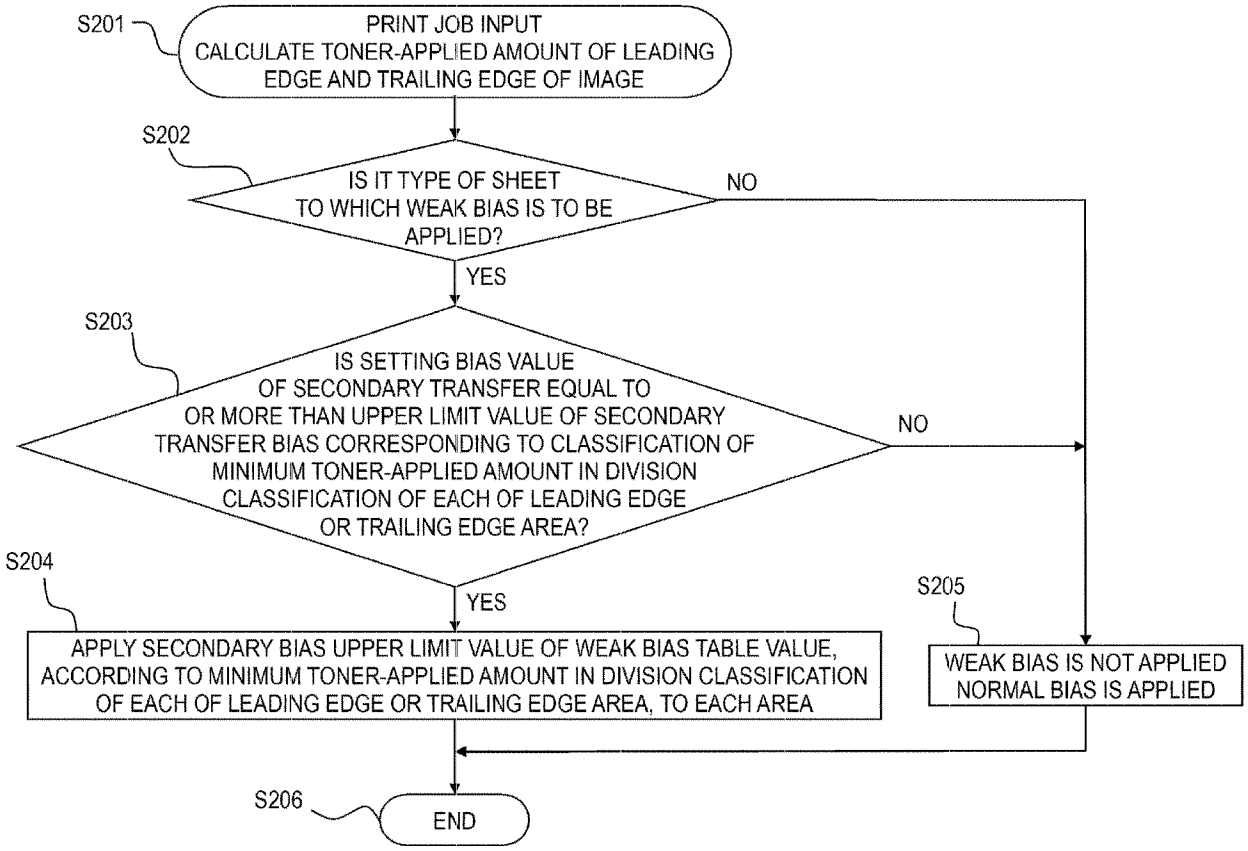
FIG. 10 is a control flow diagram of leading and trailing edge weak bias according to the first embodiment.

The control flow of the leading and trailing edge weak bias will be described with reference to FIG. 10. The control of the present embodiment is performed by the CPU 111 of the controller 110. Here, A4-sized thick paper with a basis weight of 209 g/m$^2$ is used as the transfer material. As shown in FIG. 9, in the division classification, the leading edge area A of image data is divided into 10, i.e., 1 to 10 in the main scanning direction, and among classifications 1 to 10, the maximum toner-applied amount is 100% solid image and the minimum toner-applied amount is 70% halftone image. Among 10 divisions of 1 'to 10' in the main scanning direction of trailing edge area C of image data, the maximum toner-applied amount is a 60% halftone image and the minimum is 30% halftone image. For example, a case where such an image is printed will be described.

First, a print JOB is input, and the type of the selected transfer material and the image data are sent to the CPU 111 of the controller 110, and the toner-applied amount is calculated for the toner-applied amount of each classification of the area that has been divided into 10 in the main scanning in the leading edge area and the trailing edge area (S201). Next, it is determined whether the sheet type (transfer material type) set for printing is the sheet type to which the weak bias control is applied (S202). In the main control, the weak bias is applied in the transfer material with basis weight of 200 g/m$^2$ or more like the reference example. The type of transfer material selected has a basis weight of 209 g/m$^2$ as described above, and as it is the transfer material type to which the weak bias is applied, the following comparison is made. More specifically, the upper limit value of the secondary transfer bias that is set based on the minimum toner-applied amount among 1 to 10 division classifications of the leading edge area is compared by referring to the secondary transfer bias value set by the PTVC control executed at the pre-rotation operation and the weak bias table of FIG. 8 stored in the memory 112. Likewise, for the trailing edge area, the upper limit value of the secondary transfer bias set based on the minimum toner-applied amount among the division classifications of 1 'to 10' and the secondary transfer bias value set by the PTVC control are compared (S203).

The reason why the upper limit value of the secondary transfer bias is determined based on the minimum toner-applied amount of division classification of each area is to preferentially prevent the void image from which the image is missing. When the secondary transfer bias value set by the PTVC control is equal to or greater than the upper limit value corresponding to the minimum toner-applied amount, the upper limit value of the weak bias table corresponding to the toner-applied amount in FIG. 8 is applied to the leading edge area and the trailing edge area. In the divided area, the secondary transfer bias set by the PTVC control is applied (S204) to the area of the central portion other than the above area (the central area B in FIG. 9).

Here, the secondary transfer bias value set by the PTVC control was 4.5 Kv. Out of the 10 edge classifications of leading edge area, the minimum value of the toner-applied amount is 60% halftone image, and from the weak bias table in FIG. 8, the upper limit value of the secondary transfer bias of the leading edge area is 4.0 Kv. Therefore, since the secondary transfer bias value set by the PTVC control exceeds the upper limit value corresponding to toner-applied amount, 4.0 Kv of the upper limit value is applied. For the area of the central part, the setting value of 4.5 Kv is applied. Of the 10 classifications of the trailing edge area, the minimum value of the toner-applied amount is 30% halftone image, and from the weak bias table in FIG. 8, the upper limit value of the secondary transfer bias in the trailing edge area is 4.0 Kv. Therefore, the weak bias control is applied, and 4.0 kv of the upper limit value is applied to the trailing edge area, and the image formation operation of the input image data is ended (S206).

In the case where the sheet type set for printing is not the sheet type to which the weak bias control is applied (S202), the secondary transfer bias value by the PTVC control is applied without applying the weak bias (S205). In a case where the secondary transfer bias value set by the PTVC control is less than the upper limit value of each secondary transfer bias set by the minimum value of the toner-applied amount of the leading edge area and the trailing edge area of the weak bias table (S203), the secondary transfer bias value by PTVC control is applied without applying weak bias (S205).

As described above, the weak bias control is performed by comparing the upper limit value of the secondary transfer bias which is set based on the minimum toner-applied amount among the division classifications 1 to 10 and 1 'to 10' of the leading edge area and the trailing edge area divided in the sub-scanning direction and the main scanning direction and the secondary transfer bias value by the PTVC control, so that the void image is less likely to occur. Furthermore, in a case where there is a solid image that requires a lot of transfer electric current, a higher secondary transfer bias value than a halftone image portion can be applied, and it is possible to prevent the void image in the halftone image portion without causing a density difference due to the difference in transfer efficiency with other areas.

Furthermore, in the present embodiment, the area divided in the sub-scanning direction is further divided into 10 in the main scanning direction, but the division classification is not limited thereto. With the further division, it is possible to finely determine the toner-applied amount distribution in the longitudinal direction, and therefore, it becomes possible to control the leading and trailing edge weak bias more accurately with respect to void image and density difference.

OTHER EMBODIMENTS

In the above-described embodiment, the secondary transfer bias upper limit value for each toner-applied amount is set for a transfer material having a basis weight of 200 g/m$^2$ or more, and the leading and trailing edge weak bias control is performed, but the embodiment is not limited thereto. The threshold value (predetermined value) of the basis weight of the transfer material is to be appropriately set and is not limited to 200 g/m$^2$. By further subdividing the basis weight classification, the secondary transfer bias upper limit value for each toner-applied amount may be set according to the subdivided basis weight, the data table may be stored in the memory, and the above-described weak bias control may be performed. This makes it possible to apply a more optimal bias value according to the type of transfer material and image (toner-applied amount).

In the case where a temperature and humidity sensor for detecting temperature and humidity is provided in the apparatus main body, a secondary transfer bias upper limit value for each toner-applied amount is set according to the detection environment of the sensor, so that it is possible to apply the optimum bias value according to the generation level of void image due to temperature and humidity environment difference and transferability.

In the above-described embodiment, a PTVC control method in which the constant voltage is applied and electric current is detected and the bias value is set based on the result has been exemplified as a control method for setting the bias (bias value) to be applied to the transfer member at the time of image forming, which is performed prior to image forming by the bias controller. However, the present invention is not limited thereto. For example, it may be an ATVC control method for applying a constant electric current and performing voltage detection and set the bias value based on the result.

In the embodiment described above, four image forming portions are used for multicolor image forming, but the number used is not limited, and it may be appropriately set as necessary.

In the embodiment described above, although the laser scanner apparatus is used as the exposure unit, the present invention is not limited thereto, and for example, an LED array or the like may be used.

In the embodiment described above, a process cartridge integrally having a photosensitive drum, a charging portion serving as a process unit acting on the photosensitive drum, a development unit, and a cleaning portion has been exemplified as a process cartridge detachable to the image forming apparatus, but the embodiment is not limited thereto. For example, in addition to a photosensitive drum, a process cartridge integrally having any one of a charging portion, a development unit, and a cleaning portion may be used.

Further, in the embodiment described above, although a configuration in which a process cartridge including a photosensitive drum is detachably attached to the image forming apparatus is exemplified, the embodiment is not limited thereto. For example, it may be an image forming apparatus in which each constituent member is incorporated, or an image forming apparatus in which each constituent member is detachable.

In the embodiment described above, although a printer is illustrated as an image forming apparatus, the present invention is not limited thereto. For example, the embodiment may be other image forming apparatuses such as a copying machine, a facsimile apparatus, and the like or other image forming apparatuses such as a compound machine combining these functions. The embodiment is not limited to the image forming apparatus using an intermediate transfer member, transferring toner images of respective colors in a sequentially superimposed manner to the intermediate transfer member, and transferring the toner image carried on the intermediate transfer member to the transfer material at once. The embodiment may be an image forming apparatus using a transfer material bearing member, and transferring the toner images of the colors in a sequentially superimposed manner onto the transfer material carried on the transfer material bearing member. Similar effects can be obtained by applying the present invention to these image forming apparatuses.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-022716, filed Feb. 10, 2017, which is hereby incorporated by reference herein in its entirety.

What is claimed is:

1. An image forming apparatus comprising:

an image bearing member;

a transfer member which contacts the image bearing member to form a transfer portion, the transfer portion configured to transfer a toner image formed on the image bearing member to a transfer material;

a power supply configured to apply bias to the transfer member;

a controller configured to execute a first mode and a second mode selectively, wherein the first mode is a mode for applying a first transfer bias to the transfer member when a first predetermined area arranged at a leading edge side of the transfer material passes the transfer portion and for applying a second transfer bias to the transfer member when a second predetermined area arranged in a central area of the transfer material passes the transfer portion with respect to a conveying direction of the transfer material, an absolute value of the first transfer bias being less than that of the second transfer bias, and the second mode is a mode for applying a third transfer bias to the transfer member when the first predetermined area and the second predetermined area pass the transfer portion; and an obtaining portion which obtains a video count value for each pixel, wherein the controller changes an amount of the first transfer bias applied in the first image forming mode based on an integrated amount of the video count value integrated in each of a plurality of divisional regions into which the first predetermined area is divided in a width direction perpendicular to the conveying direction, each of the plurality of divisional regions having a plurality of pixels.

2. The image forming apparatus according to claim 1, wherein the controller obtains a plurality of a setting values set according to a toner amount formed on each of the plurality of divisional regions and determines the first transfer bias based on a minimum value among the setting values obtained.

3. The image forming apparatus according to claim 1, wherein the controller executes the first image forming mode in a case where a basis weight of the transfer material is greater than or equal to a given value.

4. An image forming apparatus comprising:

an image forming device having:

an image bearing member;

a transfer member which contacts the image bearing member to form a transfer portion, the transfer portion configured to transfer a toner image formed on the image bearing member to a transfer material;

a power supply configured to apply bias to the transfer member;

a controller configured to execute a first mode and a second mode selectively, wherein the first mode is a mode for applying a first transfer bias to the transfer member when a first predetermined area arranged at a trailing edge side of the transfer material passes the transfer portion and for applying a second transfer bias to the transfer member when a second predetermined area arranged in a central area of the transfer material passes the transfer portion with respect to a conveying direction of the transfer material, an absolute value of the first transfer bias being less than that of the second transfer bias, and the second mode is a mode for applying a third transfer bias to the transfer member when the first predetermined area and the second predetermined area pass the transfer portion; and an obtaining portion which obtains a video count value for each pixel, wherein the controller changes an amount of the first transfer bias applied in the first image forming mode based on an integrated amount of the video count value integrated in each of a plurality of divisional regions into which the first predetermined area is divided in a width direction perpendicular to the conveying direction, each of the plurality of divisional regions having a plurality of pixels.

5. The image forming apparatus according to claim 4, wherein the controller obtains a plurality of a setting values set according to a toner amount formed on each of the plurality of divisional regions and determines the first transfer bias based of a minimum value among the setting values obtained.

6. The image forming apparatus according to claim 4, wherein the controller executes the first image forming mode in a case where a basis weight of the transfer material is greater than or equal to a given value.

7. An image forming apparatus comprising:

an image bearing member;

a transfer member which contacts the image bearing member to form a transfer portion, the transfer portion configured to transfer a toner image formed on the image bearing member to a transfer material;

a power supply configured to apply bias to the transfer member;

a controller configured to execute a first mode and a second mode selectively, wherein the first mode is a mode for applying a first transfer bias to the transfer member when a first predetermined area arranged at a leading edge side of the transfer material passes the transfer portion and for applying a second transfer bias to the transfer member when a second predetermined area arranged in a central area of the transfer material passes the transfer portion with respect to a conveying direction of the transfer material, an absolute value of the first transfer bias being less than that of the second transfer bias, and the second mode is a mode for applying a third transfer bias to the transfer member when the first predetermined area and the second predetermined area pass the transfer portion; and an obtaining portion which obtains a video count value for each pixel, wherein the controller selectively executes the first image forming mode or the second image forming mode based on an integrated amount of the video count value in each of the plurality of divisional regions of the first predetermined area, the first predetermined area being divided into a plurality of the division classifications in a width direction perpendicular to the conveying direction and each division classification having a plurality of pixels.

8. An image forming apparatus comprising:

an image bearing member;

a transfer member which contacts the image bearing member to form a transfer portion, the transfer portion configured to transfer a toner image formed on the image bearing member to a transfer material;

a power supply configured to apply bias to the transfer member;

a controller configured to execute a first mode and a second mode selectively, wherein the first mode is a mode for applying a first transfer bias to the transfer member when a first predetermined area arranged at a trailing edge side of the transfer material passes the transfer portion and for applying a second transfer bias to the transfer member when a second predetermined area arranged in a central area of the transfer material passes the transfer portion with respect to a conveying direction of the transfer material, an absolute value of the first transfer bias being less than that of the second transfer bias, and the second mode is a mode for applying a third transfer bias to the transfer member when the first predetermined area and the second predetermined area pass the transfer portion; and an obtaining portion which obtains a video count value for each pixel, wherein the controller selectively executes the first image forming mode or the second image forming mode based on an integrated amount of the video count value in each of the plurality of divisional regions of the first predetermined area, the first predetermined area being divided into a plurality of the division classifications in a width direction perpendicular to the conveying direction and each division classification having a plurality of pixels.

* * * * *